US007977453B2

(12) United States Patent
Newton

(10) Patent No.: US 7,977,453 B2
(45) **Date of Patent: *Jul. 12, 2011**

(54) PROCESSES FOR HYDROLYZING POLYPHOSPHORIC ACID IN SHAPED ARTICLES

(75) Inventor: Christopher William Newton, Richmond, VA (US)

(73) Assignees: E. I. du Pont de Nemours and Company, Wilmington, DE (US); Magellan Systems International, LLC, Richmond, VA (US)

( * ) Notice: Subject to any disclaimer, the term of this patent is extended or adjusted under 35 U.S.C. 154(b) by 732 days.

This patent is subject to a terminal disclaimer.

(21) Appl. No.: 11/909,948

(22) PCT Filed: Mar. 27, 2006

(86) PCT No.: PCT/US2006/011267

§ 371 (c)(1),
(2), (4) Date: Sep. 27, 2007

(87) PCT Pub. No.: WO2006/105079

PCT Pub. Date: Oct. 5, 2006

(65) Prior Publication Data

US 2008/0188639 A1 Aug. 7, 2008

Related U.S. Application Data

(60) Provisional application No. 60/665,745, filed on Mar. 28, 2005.

(51) Int. Cl.

| | |
|---|---|
| ***C08G 73/12*** | (2006.01) |
| ***C08G 73/22*** | (2006.01) |
| *C08G 73/06* | (2006.01) |
| *C08G 73/08* | (2006.01) |

(52) U.S. Cl. ..... 528/423; 528/398; 528/480; 528/500; 528/503; 264/230; 264/232

(58) Field of Classification Search ..... 528/423, 528/480, 500, 503, 398; 264/230, 232

See application file for complete search history.

(56) References Cited

U.S. PATENT DOCUMENTS

| | | | | |
|---|---|---|---|---|
| 3,227,793 | A | 1/1966 | Cipiani | 264/203 |
| 3,414,645 | A | 12/1968 | Morgan, Jr. | 264/210 |
| 3,424,720 | A | 1/1969 | Rudner et al. | 260/47 |
| 3,767,756 | A | 10/1973 | Blades | 264/184 |
| 3,804,804 | A | 4/1974 | Gerber et al. | 260/47 CP |
| 3,940,955 | A | 3/1976 | Welsh | 68/20 |
| 3,996,321 | A | 12/1976 | Weinberger | 264/40.3 |
| 4,002,679 | A | 1/1977 | Arnold | 260/556 A |
| 4,070,431 | A | 1/1978 | Lewis et al. | 264/180 |
| 4,078,034 | A | 3/1978 | Lewis | 264/181 |

(Continued)

FOREIGN PATENT DOCUMENTS

EP 0 481 403 B1 5/1996

(Continued)

OTHER PUBLICATIONS

Claims 1-2 and 4-11 of U.S. Appl. No. 11/909,947.*

(Continued)

*Primary Examiner* — Duc Truong
(74) *Attorney, Agent, or Firm* — Woodcock Washburn LLP

(57) ABSTRACT

The present invention relates to processes for hydrolyzing polyphosphoric acid in shaped articles.

12 Claims, 5 Drawing Sheets

U.S. PATENT DOCUMENTS

| | | | | |
|---|---|---|---|---|
| 4,079,039 | A | 3/1978 | Gerber | 260/47 CP |
| 4,298,565 | A | 11/1981 | Yang | 264/181 |
| 4,452,971 | A | 6/1984 | Choe et al. | 528/336 |
| 4,533,693 | A | 8/1985 | Wolfe et al. | 524/417 |
| 4,703,103 | A | 10/1987 | Wolfe et al. | 528/179 |
| 4,772,678 | A | 9/1988 | Sybert et al. | 528/179 |
| 4,845,150 | A | 7/1989 | Kovak et al. | 524/602 |
| 4,847,350 | A | 7/1989 | Harris | 528/179 |
| 4,898,924 | A | 2/1990 | Chenevey et al. | 528/183 |
| 4,939,235 | A | 7/1990 | Harvey et al. | 528/337 |
| 4,963,428 | A | 10/1990 | Harvey et al. | 428/220 |
| 5,041,522 | A | 8/1991 | Dang et al. | 528/183 |
| 5,089,591 | A | 2/1992 | Gregory et al. | 528/185 |
| 5,168,011 | A | 12/1992 | Kovar et al. | 428/373 |
| 5,276,128 | A | 1/1994 | Rosenberg et al. | 528/184 |
| 5,367,042 | A | 11/1994 | Pierini et al. | 528/183 |
| 5,393,478 | A | 2/1995 | Sen et al. | 264/203 |
| 5,429,787 | A | 7/1995 | Im et al. | 264/344 |
| 5,525,638 | A | 6/1996 | Sen et al. | 521/61 |
| 5,552,221 | A | 9/1996 | So et al. | 428/373 |
| 5,667,743 | A | 9/1997 | Tai et al. | 264/184 |
| 5,674,969 | A | 10/1997 | Sikkema et al. | 528/183 |
| 5,772,942 | A | 6/1998 | Teramoto et al. | 264/184 |
| 6,228,922 | B1 | 5/2001 | Wang et al. | 542/413 |
| 7,776,246 | B2 * | 8/2010 | Allen et al. | 264/211.12 |
| 2003/0083421 | A1 | 5/2003 | Kumar et al. | 524/496 |
| 2006/0019094 | A1 | 1/2006 | Lee | 428/364 |

FOREIGN PATENT DOCUMENTS

| | | | |
|---|---|---|---|
| EP | 0 834 608 | B1 | 3/2002 |
| EP | 1 553 143 | A1 | 7/2005 |
| GB | 1 361 840 | | 7/1974 |
| JP | 06-240596 | | 8/1994 |
| JP | 09-78349 | | 3/1997 |
| WO | WO 91/02764 | A1 | 3/1991 |
| WO | WO 94/12702 | A1 | 6/1994 |
| WO | WO 96/20303 | A1 | 7/1996 |
| WO | WO 99/27169 | A1 | 6/1999 |
| WO | WO2004/003080 | A1 | 1/2004 |
| WO | WO2004/003269 | A1 | 1/2004 |
| WO | WO2004/024797 | A1 | 2/2004 |
| WO | WO 2006/014718 | A1 | 2/2006 |
| WO | WO2006/105076 | A2 | 10/2006 |
| WO | WO2006/105225 | A1 | 10/2006 |
| WO | WO2006/105226 | A1 | 10/2006 |
| WO | WO2006/105231 | A1 | 10/2006 |

OTHER PUBLICATIONS

Claims 1-20 of U.S. Appl. No. 11/909,950.*

Gerber, A.H., "Thermally stable polymers derived from 2,3,5,6-tetraaminopyridine," J. of Polymer Science, 1973, 11, 1703-1719.

Lammers, M., et al., "Mechanical properties and structural transitions in the new rigid-rod polymer fibre PIPD ('M5') during the manufacturing process," Elsevier Sci. Ltd., 1997, S0032-3861, 7 pages.

Sikkema, D.J., "Design, synthesis and properties of a novel rigid rod polymer, PIPD or 'MS': high modulus and tenacity fibers with substantial compressive strength," Polymer, 1998, 39(24), 5981-5986.

* cited by examiner

PROCESSES FOR HYDROLYZING POLYPHOSPHORIC ACID IN SHAPED ARTICLES

CROSS-REFERENCE TO RELATED APPLICATIONS

This application is the National Stage of International Application No. PCT/US2006/011267, filed Mar. 27, 2006, which claims the benefit of U.S. Provisional Application Nos. 60/665,745, filed Mar. 28, 2005, the disclosure of which is incorporated herein by reference in its entirety.

FIELD OF THE INVENTION

The present invention generally relates to polymer fibers and processes for the preparation of such fibers. More particularly, the present invention relates to methods of removing polyphosphoric acid, inter alia, from filaments and spun yarns comprising polymers.

BACKGROUND OF THE INVENTION

Many fibers are prepared from a solution of the polymer in a solvent (called the "polymer dope") by extruding or spinning the polymer dope through a die or spinneret to prepare or spin a dope filament. The solvent is subsequently removed to provide the fiber or yarn. In the preparation of certain fibers, the solvent utilized is a solvent acid, such as polyphosphoric acid (PPA). Unlike many typical solvents, PPA removal is generally more difficult, in part due to its polymeric nature. Incorporation of heteroatoms into the polymer may also act to inhibit removal of polyphosphoric acid from the fiber or yarn. Existing processes for removal of polymeric PPA solvent from a polymeric material typically require long washing times or elevated leaching temperatures if a substantial amount of PPA is to be removed.

For example, Sen et al., U.S. Pat. No. 5,393,478, discloses a process for leaching polyphosphoric acid from the polybenzazole dope filament by contacting with a leaching fluid at a temperature of at least about 60° C.

Sen et al., U.S. Pat. No. 5,525,638, discloses a process for washing polyphosphoric acid from the polybenzazole dope filament by using multiple washes, typically at about room temperature, slowly reducing phosphorous concentration from the spun fiber, allegedly to improve the physical properties of the resultant polymeric fiber.

Further improvements in the physical properties of and/or removal of phosphorous from fibers spun from polyphosphoric acid are needed. These and other objects of the invention will become more apparent from the present specification and claims.

SUMMARY OF THE INVENTION

The present invention is directed, in part, to processes for hydrolyzing polyphosphoric acid in a never-dried spun multifilament yarn, comprising removing surface liquid from filaments in a never-dried spun multifilament yarn; and contacting the yarn with a hot surface to hydrolyze polyphosphoric acid, wherein the filaments remain substantially unfused.

The present invention is also directed, in part, to processes for removing the residual polyphosphoric acid from a multifilament yarn, comprising spinning a bundle of filaments from a solution comprising polyareneazole polymer and polyphosphoric acid into a coagulation bath; removing the bundle of filaments from the bath in the form of a multifilament yarn; removing surface liquid from the filaments in the yarn; contacting the yarn with a hot surface to hydrolyze polyphosphoric acid; and removing hydrolyzed polyphosphoric acid from the yarn, wherein the filaments remain substantially unfused.

The invention is also directed, in part, to processes for hydrolyzing polyphosphoric acid in a never-dried filament comprising polyareneazole and polyphosphoric acid, the process comprising removing surface liquid from the filament, and contacting the filament with a hot surface to hydrolyze polyphosphoric acid.

The invention is further directed, in part, to processes for hydrolyzing polyphosphoric acid in a shaped article comprising polyareneazole polymer and polyphosphoric acid, the process comprising removing surface liquid from the shaped article; and contacting the shaped article with a hot surface to hydrolyze polyphosphoric acid.

BRIEF DESCRIPTION OF THE DRAWINGS

The invention may be more fully understood from the following detailed description thereof in connection with accompanying drawings described as follows.

DETAILED DESCRIPTION OF ILLUSTRATIVE EMBODIMENTS

Figure 1:
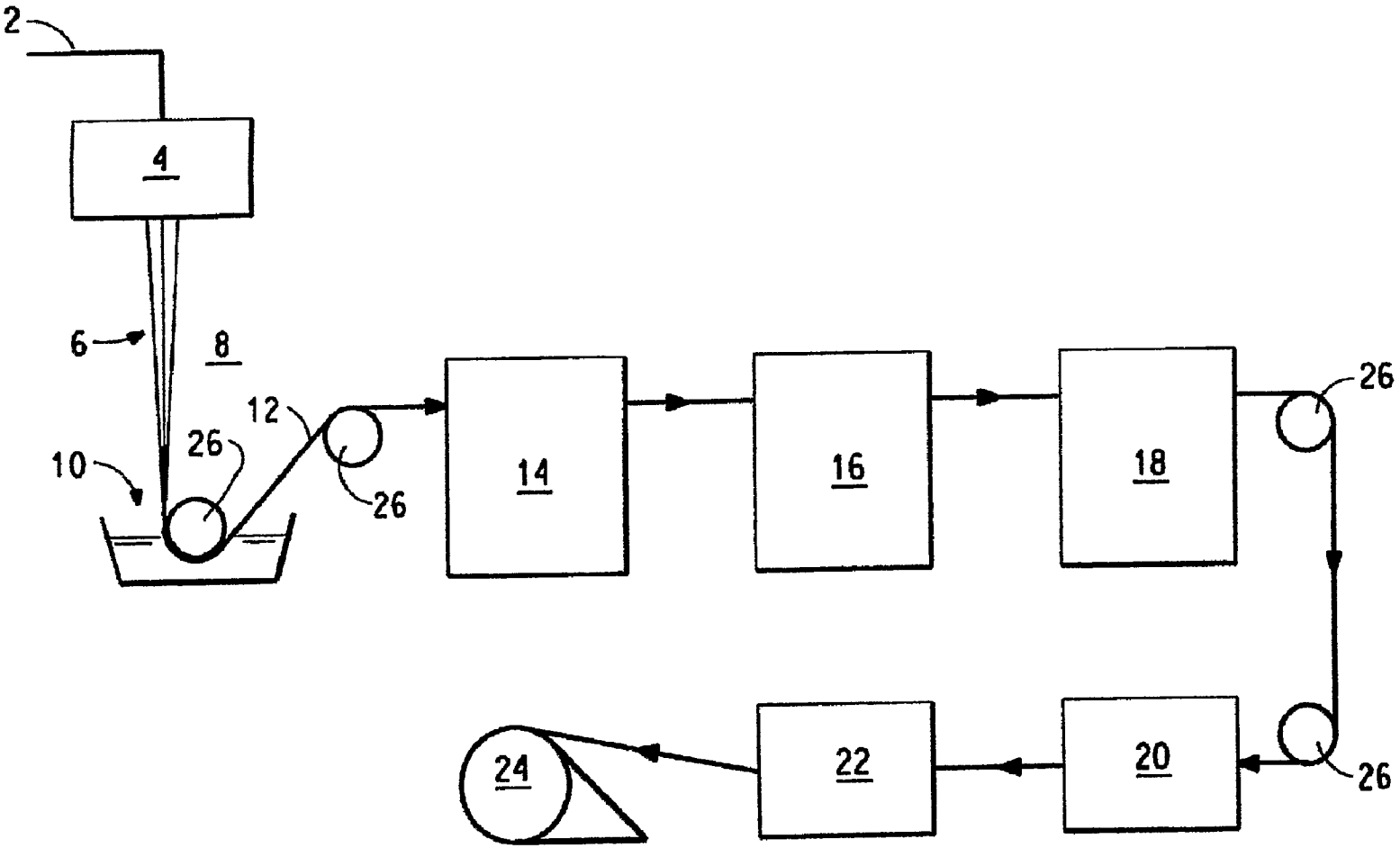
FIG. 1 is a schematic diagram of a polyarenezole fiber production process.

As employed above and throughout the disclosure, the following terms, unless otherwise indicated, shall be understood to have the following meanings.

Filaments of the present invention can be made from polyareneazole polymer. As defined herein, "polyareneazole" refers to polymers having either:

one heteroaromatic ring fused with an adjacent aromatic group (Ar) of repeating unit structure (a):

(a)

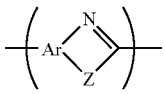

wherein N is a nitrogen atom and Z is a sulfur, oxygen, or NR group wherein R is hydrogen or a substituted or unsubstituted alkyl or aryl attached to N; or two hetero aromatic rings each fused to a common aromatic group ($Ar^1$) of either of the repeating unit structures (b1 or b2):

(b1)

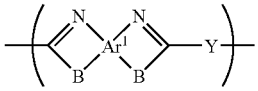

or (b2)

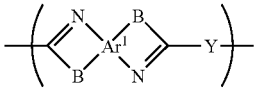

wherein N is a nitrogen atom and B is an oxygen, sulfur, or NR group, wherein R is hydrogen or a substituted or unsubstituted alkyl or aryl attached to N. The number of repeating unit structures represented by structures (a), (b1), and (b2) is not critical. Preferably, each polymer chain has from 10 to 25,000 repeating units. Polyareneazole polymers include polybenzazole polymers or polypyridazole polymers or both. In certain embodiments, the polybenzazole polymers comprise polybenzimidazole or polybenzobisimidazole polymers. In certain other embodiments, the polypyridazole polymers comprise polypyridobisimidazole or polypyridoimidazole polymers. In certain preferred embodiments, the polymers are of a polybenzobisimidazole or polypyridobisimidazole type.

In structure (b1) and (b2), Y is an aromatic, heteroaromatic, aliphatic group, or nil; preferably an aromatic group; more preferably a six-membered aromatic group of carbon atoms. Still more preferably, the six-membered aromatic group of carbon atoms (Y) has para-oriented linkages with two substituted hydroxyl groups; even more preferably 2,5-dihydroxy-para-phenylene.

In structures (a), (b1), or (b2), Ar and $Ar^1$ each represent any aromatic or heteroaromatic group. The aromatic or heteroaromatic group can be a fused or non-fused polycyclic system, but is preferably a single six-membered ring. More preferably, the Ar or $Ar^1$ group is heteroaromatic, wherein a nitrogen atom is substituted for one of the carbon atoms of the ring system or Ar or $Ar^1$ may contain only carbon ring atoms. Still more preferably, the Ar or $Ar^1$ group is heteroaromatic.

As herein defined, "polybenzazole" refers to polyareneazole polymer having repeating structure (a), (b1), or (b2) wherein the Ar or $Ar^1$ group is a single six-membered aromatic ring of carbon atoms. Preferably, polybenzazoles are a class of rigid rod polybenzazoles having the structure (b1) or (b2); more preferably rigid rod polybenzazoles having the structure (b1) or (b2) with a six-membered carbocyclic aromatic ring $Ar^1$. Such preferred polybenzazoles include, but are not limited to polybenzimidazoles (B═NR), polybenzthiazoles (B═S), polybenzoxazoles (B═O), and mixtures or copolymers thereof. When the polybenzazole is a polybenzimidazole, preferably it is poly(benzo[1,2-d:4,5-d']bisimidazole-2,6-diyl-1,4-phenylene). When the polybenzazole is a polybenzthiazole, preferably it is poly(benzo[1,2-d:4,5-d'] bisthiazole-2,6-diyl-1,4-phenylene). When the polybenzazole is a polybenzoxazole, preferably it is poly(benzo[1,2-d: 4,5-d']bisoxazole-2,6-diyl-1,4-phenylene).

As herein defined, "polypyridazole" refers to polyareneazole polymer having repeating structure (a), (b1), or (b2) wherein the Ar or $Ar^1$ group is a single six-membered aromatic ring of five carbon atoms and one nitrogen atom. Preferably, these polypyridazoles are a class of rigid rod polypyridazoles having the structure (b1) or (b2), more preferably rigid rod polypyridazoles having the structure (b1) or (b2) with a six-membered heterocyclic aromatic ring $Ar^1$. Such more preferred polypyridazoles include, but are not limited to polypyridobisimidazole (B═NR), polypyridobisthiazole (B═S), polypyridobisoxazole (B═O), and mixtures or copolymers thereof. Yet more preferred, the polypyridazole is a polypyridobisimidazole (B═NR) of structure:

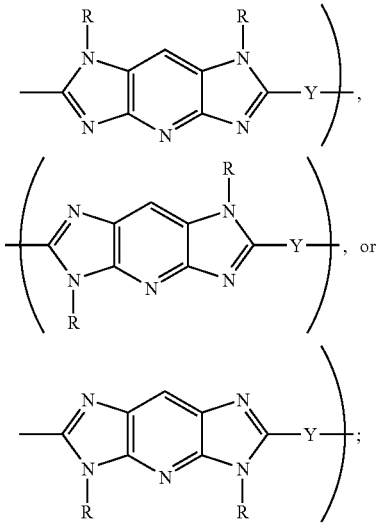

wherein N is a nitrogen atom, R is hydrogen or a substituted or unsubstituted alkyl or aryl attached to N, preferably wherein R is H, and Y is as previously defined. The number of repeating structures or units represented by structures is not critical. Preferably, each polymer chain has from 10 to 25,000 repeating units.

Filaments of the present invention are prepared from polybenzazole (PBZ) or polypyridazole polymers. For purposes herein, the term "filament" or "fiber" refers to a relatively flexible, macroscopically homogeneous body having a high ratio of length to width across its cross-sectional area perpendicular to its length. The filament cross section may be any shape, but is typically circular.

As herein defined, "yarn" refers to a number of filaments laid, bundled, or assembled together with or without a degree of twist or interlacing, forming a continuous strand, which can be used, for example, in weaving, knitting, plaiting, or braiding, wherein fiber is as defined hereinabove.

For purposes herein, "fabric" refers to any woven, knitted, or non-woven structure. By "woven" is meant any fabric weave, such as, plain weave, crowfoot weave, basket weave, satin weave, twill weave, and the like. By "knitted" is meant a structure produced by interlooping or intermeshing one or more ends, fibers or multifilament yarns. By "non-woven" is meant a network of fibers, including unidirectional fibers, felt, and the like.

As herein defined, "coagulation bath" refers to a medium provided to coagulate the dope filament. The bath comprises a liquid, typically an alcohol, water, aqueous acid, or other aqueous liquid mixture. Preferably, the bath is water or aqueous phosphoric acid, but the liquid may be anything that provides water or other moiety that may assist in the hydrolysis of PPA.

In some embodiments, the more preferred rigid rod polypyridazoles include, but are not limited to polypyridobisimidazole homopolymers and copolymers such as those described in U.S. Pat. No. 5,674,969 (to Sikkema, et al. on Oct. 7, 1997). One such exemplary polypyridobisimidazole is homopolymer poly(1,4-(2,5-dihydroxy) phenylene-2,6-diimidazo[4,5-b:4'5'-e]pyridinylene).

The polyareneazole polymers used in this invention may have properties associated with a rigid-rod structure, a semi-rigid-rod structure, or a flexible coil structure; preferably a rigid rod structure. When this class of rigid rod polymers has structure (b1) or (b2) it preferably has two azole groups fused to the aromatic group $Ar^1$.

Suitable polyareneazoles useful in this invention include homopolymers and copolymers. Up to as much as 25 percent by weight of other polymeric material can be blended with the polyareneazole. Also copolymers may be used having as much as 25 percent or more of other polyareneazole monomers or other monomers substituted for a monomer of the majority polyareneazole. Suitable polyareneazole homopolymers and copolymers can be made by known procedures, such as those described in U.S. Pat. Nos. 4,533,693 (to Wolfe et al. on Aug. 6, 1985), 4,703,103 (to Wolfe et al. on Oct. 27, 1987), 5,089,591 (to Gregory et al. on Feb. 18, 1992), 4,772,678 (Sybert et al. on Sep. 20, 1988), 4,847,350 (to Harris et al. on Aug. 11, 1992), 5,276,128 (to Rosenberg et al. on Jan. 4, 1994) and U.S. Pat. No. 5,674,969 (to Sikkema, et al. on Oct. 7, 1997). Additives may also be incorporated in the polyareneazole in desired amounts, such as, for example, anti-oxidants, lubricants, ultra-violet screening agents, colorants, and the like.

This invention is generally directed to polyareneazole filaments, more specifically to polybenzazole (PBZ) filaments or polypyridazole filaments, and processes for the preparation of such filaments. The invention further relates to yarns, fabrics, and articles incorporating filaments of this invention and processes for making such yarns, fabrics, and articles.

When any variable occurs more than one time in any constituent or in any formula, its definition in each occurrence is independent of its definition at every other occurrence. Combinations of substituents and/or variables are permissible only if such combinations result in stable compounds.

Accordingly, in certain embodiments, the present invention is directed to processes for hydrolyzing polyphosphoric acid in a never-dried spun multifilament yarn, comprising removing surface liquid from filaments in a never-dried spun multifilament yarn; and contacting the yarn with a hot surface to hydrolyze polyphosphoric acid, wherein the filaments remain substantially unfused. Removing surface liquid from filaments of never-dried yarns may be accomplished in any number of ways, such as, for example, air drying, water spraying, vacuum drying, and methods employing heat to assist in the removal of surface liquids. In some embodiments, the filaments are dried to remove the surface liquid. Typically the drying to remove surface liquid is performed at a temperature of less than about 140° C. In some preferred embodiments, the drying is performed on heated rolls, typically at a temperature of less than about 120° C. In certain embodiments, it may be advantageous to rinse the yarn with aqueous fluid prior to removing surface liquid from filaments of the yarn. The hot surface employed in the yarn contacting to hydrolyze polyphosphoric acid is not critical. In some embodiments, heated rolls may provide the hot surface. Typically, the hot surface employed to hydrolyze the polyphosphoric acid has a surface temperature of at least about 150° C., preferably at least about 180° C. In some embodiments, the process further comprises a step wherein hydrolyzed polyphosphoric acid is removed from the yarn. In other embodiments where it may be advantageous to remove hydrolyzed polyphosphoric acid, the removal of hydrolyzed polyphosphoric acid from the yarn may include washing the yarn with base; more preferably, the yarn may be washed with water prior to and after washing with base. Typically, the base selected should be strong enough to break a bond or association between the polymer and the phosphoric acid and typically includes sodium hydroxide, potassium hydroxide, ammonium hydroxide, sodium bicarbonate, or any combination thereof, preferably sodium hydroxide, potassium hydroxide, or any combination thereof. In certain embodiments, removing hydrolyzed polyphosphoric acid may include washing the yarn with base and subsequent washing with acid, typically a volatile acid. Suitable, non-limiting examples of volatile acids include formic acid, acetic acid, propionic acid, butyric acid, isobutyric acid, pivalic acid, or any combination thereof; preferably acetic acid, propionic acid, or any combination thereof. In still other embodiments, the multifilament yarn comprises filaments of a polyareneazole; more preferably wherein the polyareneazole is a polypyridazole. In certain other embodiments, the polyareneazole is a polypyridobisimidazole; more preferably poly(1,4-(2,5-dihydroxy) phenylene-2,6-diimidazo[4,5-b:4'5'-e]pyridinylene). In still other embodiments, the polyareneazole is a polybenzazole, and more preferably a polybenzobisoxazole. In certain embodiments, substantially all of the polyphosphoric acid is hydrolyzed during the contacting of the yarn with a hot surface.

The present invention is also directed, in part, to processes for removing residual polyphosphoric acid from a multifilament yarn, comprising spinning a bundle of filaments from a solution comprising polyareneazole polymer and polyphosphoric acid into a coagulation bath; removing the bundle of filaments from the bath in the form of a multifilament yarn; removing surface liquid from the filaments in the yarn; contacting the yarn with a hot surface to hydrolyze polyphosphoric acid; and removing hydrolyzed polyphosphoric acid from the yarn, wherein the filaments remain substantially unfused. Removing surface liquid from filaments of multi-filament yarns may be accomplished in any number of ways, such as, for example, air drying, water spraying, vacuum drying, and methods employing heat to assist in the removal of surface liquids. In some embodiments, the filaments are dried to remove the surface liquid. Typically the drying to remove surface liquid is performed at a temperature of less than about 140° C. In some preferred embodiments, the drying is performed on heated rolls, typically at a temperature or less than about 120° C. In certain embodiments, it may be advantageous to rinse the yarn with aqueous fluid prior to removing surface liquid from filaments of the yarn. The hot surface employed in the yarn contacting to hydrolyze polyphosphoric acid is not critical. In some embodiments, heated rolls may provide the hot surface. Typically, the hot surface employed to hydrolyze the polyphosphoric acid has a surface temperature of at least about 150° C., preferably at least about 180° C. In some embodiments, the process further comprises a step wherein hydrolyzed polyphosphoric acid is removed from the yarn. In other embodiments where it may be advantageous to remove hydrolyzed polyphosphoric acid, the removal of hydrolyzed polyphosphoric acid from the yarn may include washing the yarn with base; more preferably, the yarn may be washed with water prior to and after washing with base. Typically, the base selected should be strong enough to break a bond or association between the polymer and the phosphoric acid and typically includes sodium hydroxide, potassium hydroxide, ammonium hydroxide, sodium bicarbonate, or any combination thereof, preferably sodium hydroxide, potassium hydroxide, or any combination thereof. In certain embodiments, removing hydrolyzed polyphosphoric acid may include washing the yarn with base and subsequent washing with acid, typically a volatile acid. Suitable, non-limiting examples of volatile acids include formic acid, acetic acid, propionic acid, butyric acid, isobutyric acid, pivalic acid, or any combination thereof; preferably acetic acid, propionic acid, or any combination thereof. In still other embodiments, the multifilament yarn comprises filaments of a polyareneazole; more preferably wherein the polyareneazole is a polypyridazole. In certain other embodiments, the polyareneazole is a polypyridobisimidazole; more preferably poly(1,4-(2,5-dihydroxy) phenylene-2,6-diimidazo[4,5-b:4'5'-e]pyridinylene). In still other embodiments, the polyareneazole is a polybenzazole, and more preferably a polybenzobisoxazole. In certain embodiments, substantially all of the polyphosphoric acid is hydrolyzed during the contacting of the yarn with a hot surface.

The invention is also directed, in part, to processes for hydrolyzing polyphosphoric acid in a never-dried filament comprising polyareneazole and polyphosphoric acid, the process comprising removing surface liquid from the filament, and contacting the filament with a hot surface to hydrolyze polyphosphoric acid. Typically this is carried out in the presence of a liquid that provides water or other moiety that may assist in the hydrolysis of PPA. Removing surface liquid from a never-dried filament may be accomplished in any number of ways, such as, for example, air drying, water spraying, vacuum drying, and methods employing heat to assist in the removal of surface liquid. In some embodiments, the filament is dried to remove the surface liquid. In some preferred embodiments, the hot surface contacting required for hydrolyzing is performed on heated rolls. Typically the drying to remove surface liquid is performed at a temperature of less than about 140° C. In some preferred embodiments, the drying is performed on heated rolls, typically at a temperature of less than about 120° C. In certain embodiments, it may be advantageous to rinse the yarn with aqueous fluid prior to removing surface liquid from filaments of the yarn. The hot surface employed in the yarn contacting to hydrolyze polyphosphoric acid is not critical. In some embodiments, heated rolls may provide the hot surface. Typically, the hot surface employed to hydrolyze the polyphosphoric acid has a surface temperature of at least about 150° C., preferably at least about 180° C. In some embodiments, the process further comprises a step wherein the hydrolyzed polyphosphoric acid is removed from the filament. In still other embodiments, the filament comprises polyareneazole; more preferably wherein the polyareneazole is a polypyridazole. In certain other embodiments, the polyareneazole is a polypyridobisimidazole; more preferably poly(1,4-(2,5-dihydroxy) phenylene-2,6-diimidazo[4,5-b:4'5'-e]pyridinylene). In still other embodiments, the polyareneazole is a polybenzazole, and more preferably a polybenzobisoxazole. In certain embodiments, substantially all of the polyphosphoric acid is hydrolyzed during the contacting of the yarn with a hot surface. In other embodiments, the filament typically comprises less than 2 percent phosphorus based on filament weight after removing hydrolyzed polyphosphoric acid from the filament. In yet other embodiments, the surface liquid may be removed, for example, by evaporation, drying, blowing, absorption, scraping, wicking, stripping, dripping, or any combination thereof.

The invention is further directed, in part, to processes for hydrolyzing polyphosphoric acid in a shaped article comprising polyareneazole polymer and polyphosphoric acid, the process comprising removing surface liquid from the shaped article; and contacting the shaped article with a hot surface to hydrolyze polyphosphoric acid. Typically this is carried out in the presence of a liquid that provides water or other moiety that may assist in the hydrolysis of PPA. Removing surface liquid from the shaped article may be accomplished in any number of ways, such as, for example, air drying, water spraying, vacuum drying, and methods employing heat to assist in the removal of surface liquid. In some embodiments, the shaped article is dried to remove the surface liquid. Typically the drying to remove surface liquid is performed at a temperature of less than about 140° C., more typically at a temperature of less than about 120° C. In certain embodiments, it may be advantageous to rinse the shaped article with aqueous fluid prior to removing surface liquid associated with the shaped article. The hot surface employed in the shaped article contacting to hydrolyze polyphosphoric acid is not critical. Typically, the hot surface employed to hydrolyze the polyphosphoric acid has a surface temperature of at least about 150° C., preferably at least about 180° C. In some embodiments, the process further comprises a step wherein the hydrolyzed polyphosphoric acid is removed from the shaped article. In still other embodiments, the shaped article comprises polyareneazole; more preferably wherein the polyareneazole is a polypyridazole. In certain other embodiments, the polyareneazole is a polypyridobisimidazole; more preferably poly(1,4-(2,5-dihydroxy) phenylene-2,6-diimidazo[4,5-b:4'5'-e]pyridinylene). In still other embodiments, the polyareneazole is a polybenzazole, and more preferably a polybenzobisoxazole. In certain embodiments, substantially all of the polyphosphoric acid is hydrolyzed during the contacting of the shaped article with a hot surface. In other embodiments, the shaped article typically comprises less than 2 percent phosphorus based on shaped article weight after removing hydrolyzed polyphosphoric acid from the shaped article. In yet other embodiments, the surface liquid may be removed, for example, by evaporation, drying, blowing, absorption, scraping, wicking, stripping, dripping, or any combination thereof.

Suitable polyareneazole monomers are reacted in a solution of non-oxidizing and dehydrating acid under non-oxidizing atmosphere with mixing at a temperature that is increased in step-wise or ramped fashion from no more than about 120° C. to at least about 170° C. The polyareneazole polymer can be rigid rod, semi-rigid rod or flexible coil. It is preferably a lyotropic liquid-crystalline polymer, which forms liquid-crystalline domains in solution when its concentration exceeds a critical concentration. The inherent viscosity of rigid polyareneazole polymers in methanesulfonic acid at 30° C., is preferably at least about 10 dL/g, more preferably at least about 15 dL/g and most preferably at least about 20 dL/g.

Certain embodiments of the present invention are discussed in reference to FIG. 1. In some embodiments, the polymer is formed in acid solvent providing the dope solution 2. In other embodiments, the polymer is dissolved in the acid solvent after formation. Either is within the ambit of the invention. Preferably the polymer is formed in acid solvent and provided for use in the invention. The dope solution 2, comprising polymer and polyphosphoric acid, typically contains a high enough concentration of polymer for the polymer to form an acceptable filament 6 after extrusion and coagulation. When the polymer is lyotropic liquid-crystalline, the concentration of polymer in the dope 2 is preferably high enough to provide a liquid-crystalline dope. The concentration of the polymer is preferably at least about 7 weight percent, more preferably at least about 10 weight percent and most preferably at least about 14 weight percent. The maximum concentration is typically selected primarily by practical factors, such as polymer solubility and dope viscosity. The concentration of polymer is preferably no more than 30 weight percent, and more preferably no more than about 20 weight percent.

The polymer dope solution 2 may contain additives such as anti-oxidants, lubricants, ultra-violet screening agents, colorants and the like which are commonly incorporated.

The polymer dope solution 2 is typically extruded or spun through a die or spinneret 4 to prepare or spin the dope filament. The spinneret 4 preferably contains a plurality of holes. The number of holes in the spinneret and their arrangement is not critical to the invention, but it is desirable to maximize the number of holes for economic reasons. The spinneret 4 can contain as many as 100 or 1000 or more holes, and they may be arranged in circles, grids, or in any other desired arrangement. The spinneret 4 may be constructed out of any materials that will not be degraded by the dope solution 2.

Fibers may be spun from solution using any number of processes; however, wet spinning and "air-gap" spinning are the best known. The general arrangement of the spinnerets and baths for these spinning processes is well known in the art, with the figures in U.S. Pat. Nos. 3,227,793; 3,414,645; 3,767,756; and 5,667,743 being illustrative of such spinning processes for high strength polymers. In "air-gap" spinning the spinneret typically extrudes the fiber first into a gas, such as air. Using FIG. 1 to help illustrate a process employing "air-gap" spinning (also sometimes known as "dry-jet" wet spinning), dope solution 2 exiting the spinneret 4 enters a gap 8 (typically called an "air gap" although it need not contain air) between the spinneret 4 and a coagulation bath 10 for a very short duration of time. The gap 8 may contain any fluid that does not induce coagulation or react adversely with the dope, such as air, nitrogen, argon, helium, or carbon dioxide. The extruded dope 6 is drawn across the air gap 8, with or without stretching and immediately introduced into a liquid coagulation bath. Alternately, the fiber may be "wet-spun". In wet spinning, the spinneret typically extrudes the fiber directly into the liquid of a coagulation bath and normally the spinneret is immersed or positioned beneath the surface of the coagulation bath. Either spinning process may be used to provide fibers for use in the processes of the invention. In some embodiments of the present invention, air-gap spinning is preferred.

The extruded dope 6 is "coagulated" in the coagulation bath 10 containing water or a mixture of water and phosphoric acid, which removes enough of the polyphosphoric acid to prevent substantial stretching of the extruded dope 6 during any subsequent processing. If multiple fibers are extruded simultaneously, they may be combined into a multifilament yarn before, during or after the coagulation step. The term "coagulation" as used herein does not necessarily imply that the extruded dope 6 is a flowing liquid and changes into a solid phase. The extruded dope 6 can be at a temperature low enough so that it is essentially non-flowing before entering the coagulation bath 10. However, the coagulation bath 10 does ensure or complete the coagulation of the filament, i.e., the conversion of the polymer from a dope solution 2 to a substantially solid polymer filament 12. The amount of solvent, i.e., polyphosphoric acid, removed during the coagulation step will depend on the residence time of the dope filament in the coagulation bath, the temperature of the bath 10, and the concentration of solvent therein.

Without desiring to be bound by any particular theory of operation, it is believed that the present invention is, in part, based on the discovery that long term fiber properties are better preserved if residual phosphorus levels are low. In part, this may be achieved by hydrolyzing PPA prior to its removal from the fiber in the belief that substantially hydrolyzed polyphosphoric acid may be effectively removed from the fiber to achieve low residual phosphorus. Typically, PPA is substantially hydrolyzed under conditions whereby the fiber remains substantially non-hydrolyzed. Although many modes of practicing the invention are recognizable to one skilled in the art when armed with the present invention, PPA may be conveniently hydrolyzed by heating the filament or yarn prior to washing and/or neutralization steps. One manner of hydrolysis includes convective heating of the coagulated fiber for a short period of time. As an alternative to convective heating, the hydrolysis may be effected by heating the wet, as coagulated filament or yarn in a boiling water or aqueous acid solution. The heat treatment provides PPA hydrolysis while adequately retaining the tensile strength of the product fiber. The heat treatment step may occur in a separate cabinet 14, or as an initial process sequence followed by one or more subsequent washing steps in an existing washing cabinet 14.

In some embodiments, the hydrolysis and removal are provided by (a) contacting the dope filament with a solution in bath or cabinet 14 thereby hydrolyzing PPA and then (b) contacting the filament with a neutralization solution in bath or cabinet 16 containing water and an effective amount of a base under conditions sufficient to neutralize sufficient quantities of the phosphoric acid, polyphosphoric acid, or any combination thereof in the filament.

After treatment to substantially hydrolyze polyphosphoric acid (PPA) associated with the coagulated filament, hydrolyzed PPA may be removed from the filament or yarn 12 by washing in one or more washing steps to remove most of the residual acid solvent/and or hydrolyzed PPA from the filament or yarn 12. The washing of the filament or yarn 12 may be carried out by treating the filament or yarn 12 with a base, or with multiple washings where the treatment of the filament or yarn with base is preceded and/or followed by washings with water. The filament or yarn may also be treated subsequently with an acid to reduce the level of cations in the polymer. This sequence of washings may be carried out in a continuous process by running the filament through a series of baths and/or through one or more washing cabinets. FIG. 1 depicts one washing bath or cabinet 14. Washing cabinets typically comprise an enclosed cabinet containing one or more rolls which the filament travels around a number of times, and across, prior to exiting the cabinet. As the filament or yarn 12 travels around the roll, it is sprayed with a washing fluid. The washing fluid is continuously collected in the bottom of the cabinet and drained therefrom.

The temperature of the washing fluid(s) impacts on the diffusion rates controlling the washing process, making the temperature selection a matter of practical importance. Preferably, temperatures between 20 and 90 C are used, depending on the residence time desired. The washing fluid may be applied in vapor form (steam), but is more conveniently provided in liquid form. Preferably, a number of washing baths or cabinets are used. The residence time of the filament or yarn 12 in any one washing bath or cabinet 14 will depend on the desired concentration of residual phosphorus in the filament or yarn 12, but preferably the residence time is in the range of from about 1 second to less than about two minutes. In a continuous process, the duration of the entire washing process in the preferred multiple washing bath(s) and/or cabinet(s) is preferably no greater than about 10 minutes, more preferably more than about 5 seconds and no greater than about 160 seconds.

In some embodiments, preferred bases for the removal of hydrolyzed PPA include NaOH; KOH; $Na_2CO_3$; $NaHCO_3$; $K_2CO_3$; $KHCO_3$; ammonia; or trialkylamines, preferably tributylamine; or mixtures thereof. In one embodiment, the base is water soluble. Typical aqueous bases include NaOH, KOH, $Na_2CO_3$, $NaHCO_3$, $K_2CO_3$, and $KHCO_3$ or mixtures thereof; more typically NaOH.

After treating the fiber with base, the process may optionally include the step of contacting the filament with a washing solution containing water or acid or both to remove all or substantially all excess base or base cations otherwise bound or associated with the polymer fiber. This washing solution can be applied in a washing bath or cabinet 18.

After washing, the fiber or yarn 12 may be dried in a dryer 20 to remove water and other liquids. The temperature in the dryer is typically 80° C. to 130° C. The dryer residence time is typically 5 seconds to perhaps as much as 5 minutes at lower temperatures. The dryer can be provided with a nitrogen or other non-reactive atmosphere. Then the fiber may be optionally further processed in, for instance, a heat setting device 22. Further processing may be done in a nitrogen purged tube furnace 22 for increasing tenacity and/or relieving the mechanical strain of the molecules in the filaments. Finally, the filament or yarn 12 is wound up into a package on a windup device 24. Rolls, pins, guides, and/or motorized devices 26 are suitably positioned to transport the filament or yarn through the process.

Shaped articles as described herein include extruded or blown shapes or films, molded articles, and the like. Films can be made by known techniques such as (1) casting the dope onto a flat surface, (2) extruding the dope through an extruder to form a film, or (3) extruding and blowing the dope film to form an extruded blown film. Typical techniques for dope film extrusion include processes similar to those used for fibers, where the solution passes through a spinneret or die into an air gap or fluid layer and subsequently into a coagulant bath. More details describing the extrusion and orientation of dope films can be found in Pierini et al. (U.S. Pat. Nos. 5,367,042); Chenevey, (4,898,924); Harvey et al., (4,939,235); and Harvey et al., (4,963,428). Typically the dope film prepared is preferably no more than about 250 mils (6.35 mm) thick and more preferably it is at most about 100 mils (2.54 mm) thick.

Preferably, the phosphorus content of the dried filaments after removal of the hydrolyzed PPA is less than about 5,000 ppm (0.5%) by weight, and more preferably, less than about 4,000 ppm (0.4%) by weight, and most preferably less than about 2,000 ppm (0.2%) by weight.

The invention is further directed, in part, to a yarn comprising a plurality of the filaments of the present invention, fabrics that include filaments or yarns of the present invention, and articles that include fabrics of the present invention.

EXAMPLES

Experimental Test Methods

The test methods described below were used in the following Examples.

Temperature: All temperatures are measured in degrees Celsius (° C.).

Denier is determined according to ASTM D 1577 and is the linear density of a fiber as expressed as weight in grams of 9000 meters of fiber.

Tenacity is determined according to ASTM D 885 and is the maximum or breaking stress of a fiber as expressed as grams per denier.

Elemental Analysis: Elemental analysis of alkaline cation (M) and phosphorus (P) is determined according to the inductively coupled plasma (ICP) method as follows. A sample (1-2 grams), accurately weighed, is placed into a quartz vessel of a CEM Star 6 microwave system. Concentrated sulfuric acid (5 ml) is added and swirled to wet. A condenser is connected to the vessel and the sample is digested using the moderate char method. This method involves heating the sample to various temperatures up to 260° C. to char the organic material. Aliquots of nitric acid are automatically added by the instrument at various stages of the digestion. The clear, liquid final digestate is cooled to room temperature and diluted to 50 ml with deionized water. The solution may be analyzed on a Perkin Elmer optima inductively coupled plasma device using the manufacturers' recommended conditions and settings. A total of twenty-six different elements may be analyzed at several different wavelengths per sample. A 1/10 dilution may be required for certain elements such as sodium and phosphorus. Calibration standards are from 1 to 10 ppm.

Process Examples

Many of the following examples are given to illustrate various embodiments of the invention and should not be interpreted as limiting it in any way. All polymer solids concentrations, weight percents based on monomer, and polymer solution percent P2O5 concentrations are expressed on the basis of TD-complex as a 1:1 molar complex between TAP and DHTA. The TD-complex is believed to be a monohydrate.

In the following examples, poly([dihydroxy]para-phenylene pyridobisimidazole) filaments (also referred to herein as "PIPD", shown below in one of its tautomeric forms) were spun from a polymer solution consisting of 18 weight percent of PIPD in polyphosphoric acid. The solution was extruded from a spinneret, drawn across an air gap and coagulated in water. The yarns were then wound up wet onto bobbins without additional steps. If the yarns were not processed within 6 hours the bobbin-wound wet yarns were refrigerated until further processed.

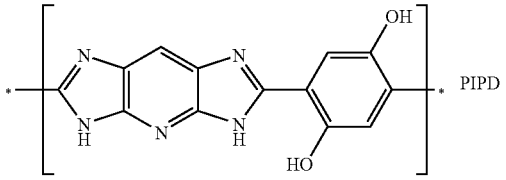

Some of the following examples are illustrative of the difficulty in hydrolyzing or removing residual (poly)phosphoric acids from freshly spun fibers. In the following examples, PIPD filaments were spun from a polymer solution containing of 18 weight percent of PIPD in polyphosphoric acid (82.1 wt % $P_2O_5$). The solution was extruded from a spinneret having approximately 250 holes, drawn across an air gap and coagulated in water.

Example 1

Figure 2:
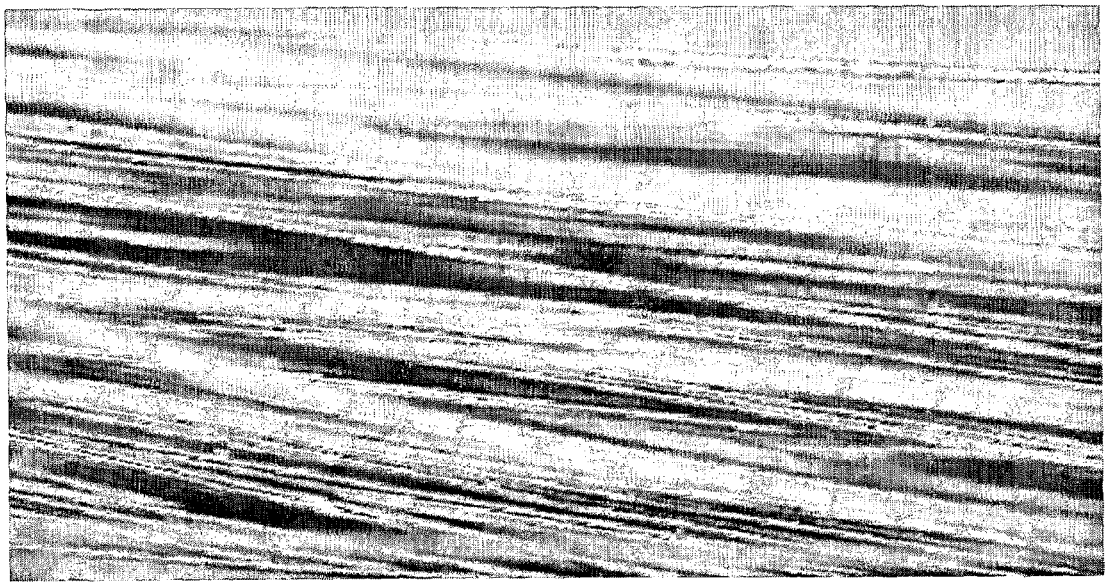
FIG. 2 is a copy of a digital photo of length of wet spun yarn.

A length of wet yarn spun as described above (FIG. 2) was placed on a hot plate operating at a surface temperature of about 180° C. in an attempt to hydrolyze residual polyphosphoric acid in the yarn. These samples remained in contact for 30 seconds. Damage developed within the first 10 seconds of contact while water evaporated. The filaments of the yarn fused together, making the yarn unusable. The experiment was repeated three more times with additional samples of wet yarn using hotplate temperatures of about 220, 240, and 260°

Figure 3:
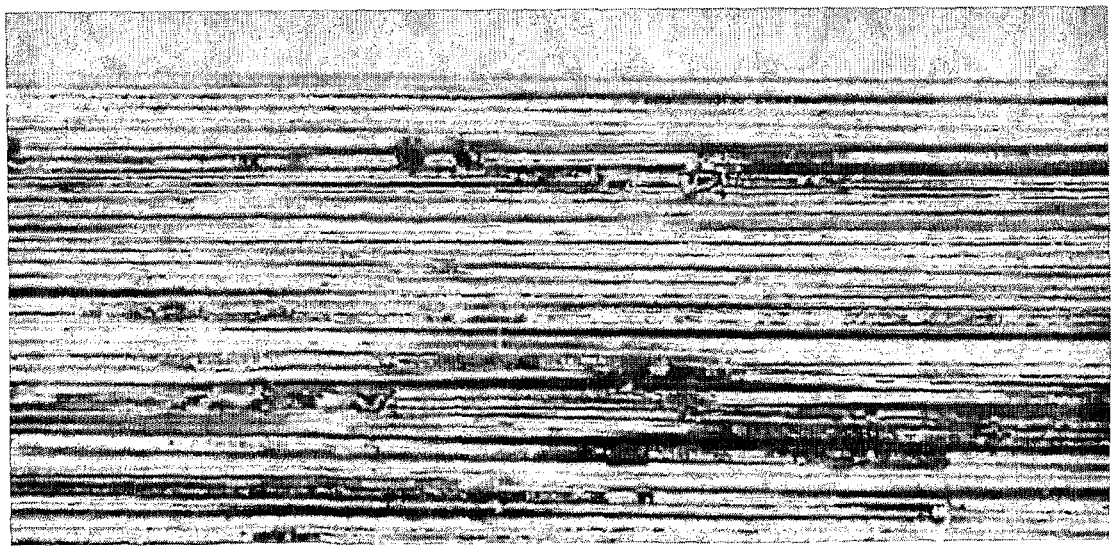
FIG. 3 is a copy of a digital photo showing the damage to filaments of the yarn heated at 180° C. on a hot plate without removing surface liquid.

C. with similar results. FIG. 3 is a copy of a digital photo of the yarn heated at about 180° C. showing the damage to the filament.

Figure 4:
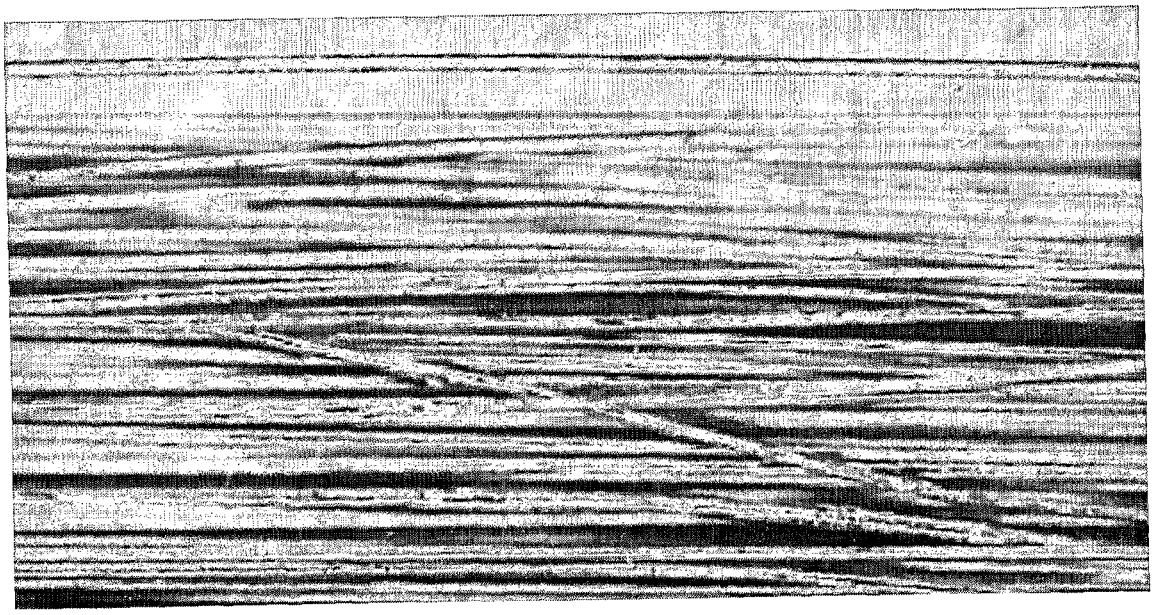
FIG. 4 is a copy of a digital photo of a yarn first air-dried to removed surface liquid and subsequently heated at 180° C. showing substantially no damage to the filaments.

Additional lengths of wet yarn spun as described were allowed to stand at room temperature in air to remove a substantial amount of surface liquid, and then placed on a hot plate to hydrolyze residual polyphosphoric acid in the yarn in the same manner and at the same temperatures as before (180, 220, 240, & 260° C.). Some of the individual filaments of the yarn treated in this manner slightly adhered to each other but were easily separated. The filaments retained their filament character without substantial damage. FIG. 4 is a copy of a digital photo of the yarn heated at about 180° C. showing substantially no damage to the filament.

Figure 5:
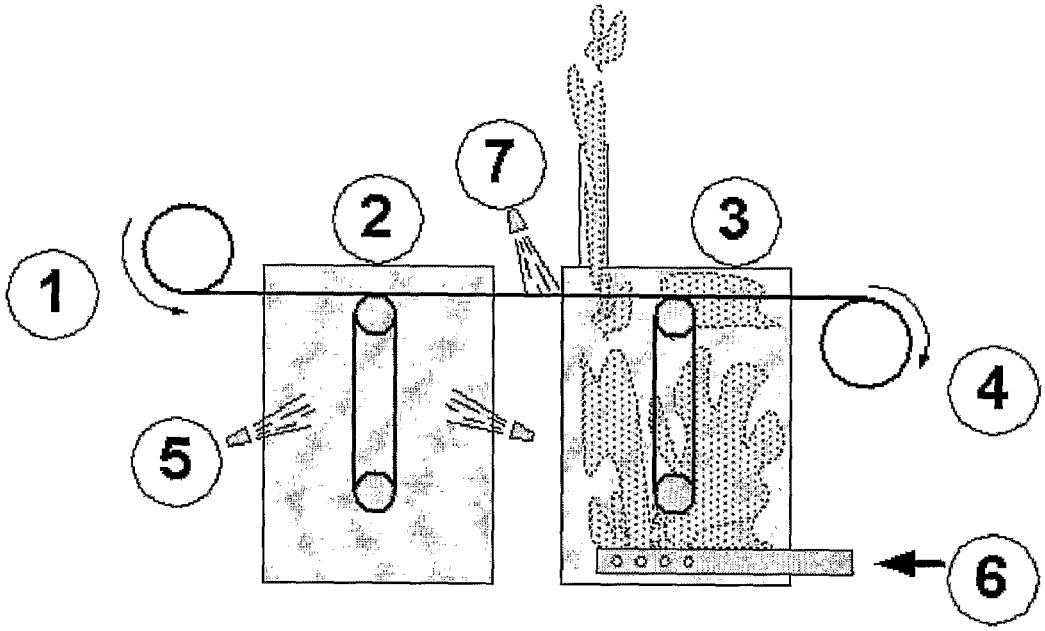
FIG. 5 is a schematic diagram of a wet processing apparatus.

In examples 2, 3, 4, and 5, the wet yarns described above were processed on the apparatus shown in FIG. 5. Wet yarn was unwound from a bobbin 1 and was fed over feed rolls 2. The feed rolls helped to maintain tension on the yarn throughout the processing. The yarn was then provided to a set of 6"-diameter, electrically-heated rolls 3 having a centerline spacing of 12 inches, where the yarn was wrapped around the rolls in spiral advancing wraps and wound onto bobbin 4. In examples 2, 3, 4, and 5, the yarn was provided with water sprays 5 while on the feed rolls for the first stage; examples 4 and 5 did not have any water sprays 5 and/or 7 for the second stage. In one example, the yarn was further provided with water sprays prior to the electrically heated rolls. Steam 6 was also provided to the yarn while on the heated rolls in certain other examples.

In some of the examples that follow, the electrically heated hot rolls 3 were operated at lower temperature (<150° C.); in some examples they were operated at higher temperature (>150° C.); and in other examples, the rolls were used to both remove surface liquid from the yarn at a lower temperature and then further process the yarns at a higher temperature to hydrolyze polyphosphoric acid. This lower and higher temperature processing was achieved by running the yarns through the apparatus twice as follows: Wet yarn was unwound from bobbins 1, and surface liquid was removed using lower temperature heated rolls 3, and the treated yarn was wound onto bobbins 4. The bobbins containing yarn with surface liquid removed were then unwound 1 and the yarn run through the apparatus a second time with the heated rolls 3 operating at a higher temperature.

Example 2

This example illustrates the undesirable fusing of filaments that occurs when wet yarns, containing typical levels of dope solvent polyphosphoric acid are processed on hot rolls in a conventional manner without a drying step before contact with the hot rolls. Three different wet as-spun feed yarns were spun as described previously, with the exception that feed yarn Number A3 in Table 1 was spun using 83 wt % $P_2O_5$ polyphosphoric acid versus 82.1 wt % $P_2O_5$. The wet yarns were processed at 61 meters/min (200 ft/min) on a pair of heated rolls 3 operating at measured surface temperatures of 180 to 260° C. and wound onto bobbins. The yarns that had been processed on heated rolls were observed to be very stiff and have unacceptable levels of fusing of individual filaments. In addition, undesirable fiber residue comprising phosphoric acid and polymer was observed fused to the hot rolls. Additional processing details and results are shown in Table 1. Items A(h), A(j), A(k), & A(l) had an additional water spray 7 added. The yarns on the bobbins were then washed and neutralized by immersing the bobbins for five minutes each in five consecutive baths maintained at room temperature. The baths were, in order, water; 2% sodium hydroxide in water; water; 2% acetic acid in water; and water. The yarns on the bobbins were then allowed to air-dry and a sample of yarn was taken. The residual phosphorus content in the yarns was found to be quite variable, ranging from about 0.77 weight percent to about 6.41 weight percent phosphorus. In addition, a sample of one of the feed yarns was washed and neutralized as before, without having been processed on heated rolls, and the residual phosphorus content of that sample was 3.5 weight percent phosphorus.

TABLE 1

| Samp. | Feed Yarn | Roll Temp (° C.) | Tension | Wraps | Yarn Denier | Phosphorus (wt %) |
|---|---|---|---|---|---|---|
| A(a) | A1 | 180 | 200 | 35 | 560 | 6.41 |
| A(b) | A1 | 180 | 250 | 17 | 493 | 2.54 |
| A(c) | A2 | 202 | 250 | 17 | 503 | 3.42 |
| A(d) | A2 | 201 | 250 | 34 | 465 | 1.77 |
| A(e) | A2 | 221 | 250 | 17 | 458 | 0.77 |
| A(f) | A3 | 221 | 250 | 17 | 423 | 3.00 |
| A(g) | A3 | 220 | 250 | 35 | 466 | 4.26 |
| A(h) | A3 | 220 | 250 | 35 | 461 | 2.97 |
| A(i) | A3 | 220 | 250 | 5 | 458 | 4.37 |
| A(j) | A3 | 220 | 250 | 5 | 442 | 2.82 |
| A(k) | A3 | 239 | 300 | 5 | 458 | 3.12 |
| A(l) | A3 | 260 | 300 | 5 | 435 | 2.15 |
| A(m) | A2 | — | — | — | 357 | 3.50 |

Example 3

The process of Example 2 was repeated with the heated roll 3 temperatures reduced. In order to determine the percent phosphorus in the heat-treated yarn, a skein sample was obtained from the yarn and washed and neutralized by immersing the skein sample for 20 seconds each in five consecutive baths. The first bath contained boiling water. The four following baths (2% sodium hydroxide in water; water; 2% acetic acid in water; and water) were maintained at 60° C. The sample was evaluated for phosphorus content as described previously.

Residual phosphorus content and levels of filament fusing were reduced somewhat in the resulting yarns when reduced hot roll temperatures were employed. The processed yarn had a residual phosphorus content of from 0.81 to 1.96. Residual phosphorus content of one of the feed yarns was determined in similar fashion but without heated roll processing; and the residual phosphorus content of that sample was 1.73 weight percent phosphorus. Additional processing details and results are shown in Table 2. Item B(c) had an additional water spray 7 prior to the heated rolls.

TABLE 2

| Sample | Feed Yarn | Roll Temp (° C.) | Tension (g) | Wraps | Phosphorus (wt %) |
|---|---|---|---|---|---|
| B(a) | B1 | 135 | 75 | 33 | 1.44 |
| B(b) | B1 | 135 | 75 | 33 | 1.65 |
| B(c) | B1 | 135 | 75 | 33 | 1.94 |
| B(d) | B1 | 162 | 75 | 33 | 0.96 |
| B(e) | B2 | 162 | 75 | 33 | 0.81 |
| B(f) | B2 | 162 | 100 | 33 | 1.1 |
| B(g) | B2 | 162 | 400 | 33 | 0.99 |
| B(h) | B2 | 162 | 100 | 35 | 1.05 |
| B(i) | B1 | — | — | — | 1.73 |

Example 4

This example illustrates a two-stage hydrolysis process, using a first stage to remove the bulk of the surface fluid and a second stage to rapidly hydrolyze polyphosphoric acid remaining with the yarn to lower molecular weight phosphoric acids or oligomers.

Two different wet as-spun feed yarns (Table 3, 2-1 and 2-2) were processed at 61 meters/min (200 ft/min) on heated rolls 3 operating at a temperature of 105° C. with the feed roll sprays 5 turned on to remove a substantial amount of surface liquid, and the resultant yarns were collected on bobbins. Yarns from these bobbins (2-2) were then processed a second time with the feed roll sprays 5 turned off and the heated rolls 3 operating at a temperature of 193 to 197° C. (second stage higher temperature rolls); the twice-processed yarns were collected on bobbins. Additional processing details are shown in Table 3. Items 2(d) & 2(e) had an additional steam atmosphere 6. Another as-spun feed yarn (Table 3, 2-3) was allowed to stand on a bobbin at room temperature for about two hours or more in air to remove a substantial amount of surface liquid and then processed directly on the second stage higher temperature rolls with the feed roll sprays 5 turned off (Items 2(h) & 2(i)). Item 2(h) had an additional steam atmosphere 6.

Samples of the feed yarn, the 105° C. treated yarn and the twice-processed yarn were then washed and neutralized. A skein sample was obtained from each yarn and washed and neutralized by immersing the skein sample for 20 seconds each in five consecutive baths. The baths were, in order, boiling water; 2% sodium hydroxide in water; water; 2% acetic acid in water; and water. The first bath containing boiling water followed by four other baths maintained at 60° C. which were, in order, 2% sodium hydroxide in water; water; 2% acetic acid in water; and water. The yarn filaments were observed to separate readily during the washing step and the yarns exhibited substantially no fusion of filaments.

The washed and neutralized yarns were then tested for residual phosphorus content. The 105° C. treated yarn and the twice-processed yarn had residual phosphorus contents of about 1.7 weight percent and 0.3 weight percent, respectively. The yarn allowed to stand at room temperature in air for about two hours or more and subsequently treated on the higher temperature rolls had residual phosphorus contents of about 0.3 weight percent. In addition, samples of the feed yarns were washed and neutralized as before, without having surface liquid removed or being processed on the heated rolls, and the residual phosphorus content of those samples was about 2.2 weight percent phosphorus.

TABLE 3

| Samp. | Feed Yarn | First Stage Temp (° C.) | Wraps | Second Stage Temp (° C.) | Wraps | Phosphorus (wt %) |
|---|---|---|---|---|---|---|
| 2(a) | 2-1 | 105 | 30 | — | — | 1.74 |
| 2(b) | 2-1 | 105 | 30 | — | — | 1.76 |
| 2(c) | 2-2 | 105 | 30 | 193 | 30 | 0.27 |
| 2(d) | 2-2 | 105 | 30 | 190 | 30 | 0.28 |
| 2(e) | 2-2 | 105 | 30 | 195 | 30 | 0.27 |
| 2(f) | 2-2 | — | — | — | — | 2.10 |
| 2(g) | 2-1 | — | — | — | — | 2.28 |
| 2(h) | 2-3 | Air Dried | — | 200 | 30 | 0.23 |
| 2(i) | 2-3 | Air Dried | — | 193 | 30 | 0.26 |

Example 5

The process of Example 4 was repeated with slightly different temperatures and fewer heated roll wraps. The resulting yarns exhibited substantially no fusion of individual filaments, and all of the twice-processed yarns had residual phosphorus contents of less than 0.5 weight percent. Additional processing details and results are shown in Table 4.

TABLE 4

| Samp. | Feed Yarn | First Stage Temp (° C.) | Wraps | Second Stage Temp (° C.) | Wraps | Phosphorus (wt %) |
|---|---|---|---|---|---|---|
| 3(a) | 3-1 | 110 | 4 | — | — | 2.16 |
| 3(b) | 3-1 | 110 | 4 | 205 | 4 | 0.48 |
| 3(c) | 3-1 | 110 | 4 | 200 | 8 | 0.14 |
| 3(d) | 3-1 | 110 | 4 | 200 | 12 | 0.48 |
| 3(e) | 3-1 | 110 | 4 | 200 | 20 | 0.32 |

The yarns in the Examples 6 through 9 were obtained directly from the spinning coagulation bath, not from bobbins. The yarn was processed on a set of 7.5"-diameter, electrically-heated rolls having a centerline spacing of 10 inches, where the yarn was wrapped around the rolls with spiral advancing wraps.

In these examples, skein samples were obtained, treated, and analyzed as described previously in example 3.

Example 6

This example illustrates a two-stage hydrolysis process, wherein the as-spun fibers are obtained directly from a coagulation bath and helps to illustrate the desirability for control of surface acid on the filaments in the as-spun yarn to avoid fusing of the filaments during surface liquid removal using lower-temperature-type heated surfaces. As before, a first stage is used to remove the bulk of the surface fluid and a second stage is used to rapidly hydrolyze polyphosphoric acid remaining with the yarn.

Figure 6:
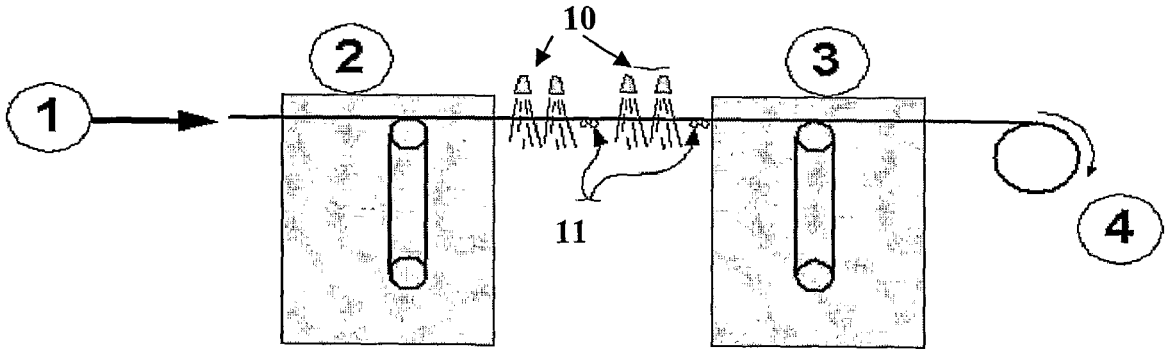
FIG. 6 is a schematic diagram of a wet processing apparatus with added water spray and stripping pins.

Two wet feed yarns, obtained directly from coagulation, were individually processed at 57 meters/min (187 ft/min) on a pair of heated rolls to remove a substantial amount of surface liquid on the yarns. Water sprays and stripping pins were added to the apparatus to first rinse and strip the acidic fluid from the surface of the filaments prior to substantial surface liquid removal from the yarn. Such an arrangement is shown in Diagram 2. Two sets of fan spray nozzles 10 alternated with two sets of stripping pins 11. The rinsing sprays were only applied to the feed yarns obtained directly from coagulation; no sprays were used on the yarn in the second stage. In FIG. 6, ① represents both yarn obtained directly from coagulation for the first stage, and also for the second stage, it represents a bobbin unwind stand for yarns from stage 1.

The roll surface temperature for treating the wet feed yarns in stage 1 was 110° C. The stage 1 yarns were then wound onto bobbins. The yarns from the bobbins were then second-stage processed at 57 meters/min (187 ft/min) on heated rolls operating at a temperature of 200° C. and the twice-processed yarn (stages 1 and 2) was collected on bobbins. Additional operating details are shown in Table 5. Samples of the Stage 1 yarn and the twice-processed yarn (stages 1 and 2) were then washed and neutralized.

The washed and neutralized yarns were tested for residual phosphorus content. The stage 1 yarn and the twice-processed yarn had residual phosphorus contents of about 2.45 to 2.48 weight percent and 0.25 to 0.76 weight percent, respectively. The twice-processed yarns had essentially no fusing or damage to the filaments.

TABLE 5

| Samp. | Feed Yarn | First Stage Temp (° C.) | Wraps | Second Stage Temp (° C.) | Wraps | Phosphorus (wt %) |
|---|---|---|---|---|---|---|
| 4(a) | 4-1 | 110 | 6 | — | — | 2.48 |
| 4(b) | 4-1 | 110 | 6 | 200 | 6 | 0.25 |
| 4(c) | 4-1 | 110 | 6 | 200 | 12 | 0.45 |
| 4(d) | 4-2 | 110 | 6 | — | — | 2.45 |
| 4(e) | 4-2 | 110 | 6 | 200 | 6 | 0.76 |

Example 7

The process of Example 6 was repeated for two feed yarns obtained directly from spinning, along with the water sprays and stripping pins, to better determine the effect of residence time on the heated rolls. Additional processing details are shown in Table 6.

The washed and neutralized yarns were then tested for residual phosphorus content. The final twice-processed yarn had very low residual phosphorus content and essentially no fusing or damage to the filaments.

TABLE 6

| Samp. | Feed Yarn | First Stage Temp (° C.) | Wraps | Second Stage Temp (° C.) | Wraps | Phosphorus (wt %) |
|---|---|---|---|---|---|---|
| 5(a) | 5-1 | 108 | 6 | — | — | 2.81 |
| 5(b) | 5-1 | 108 | 6 | 192 | 4 | 0.75 |
| 5(c) | 5-1 | 108 | 6 | 192 | 6 | 0.58 |
| 5(d) | 5-1 | 108 | 6 | 192 | 12 | 0.39 |
| 5(e) | 5-2 | 106 | 6 | — | — | 2.46 |
| 5(f) | 5-2 | 106 | 6 | 192 | 4 | 0.72 |
| 5(g) | 5-2 | 106 | 6 | 192 | 6 | 0.56 |
| 5(h) | 5-2 | 106 | 6 | 192 | 12 | 0.32 |

Example 8

Figure 7:
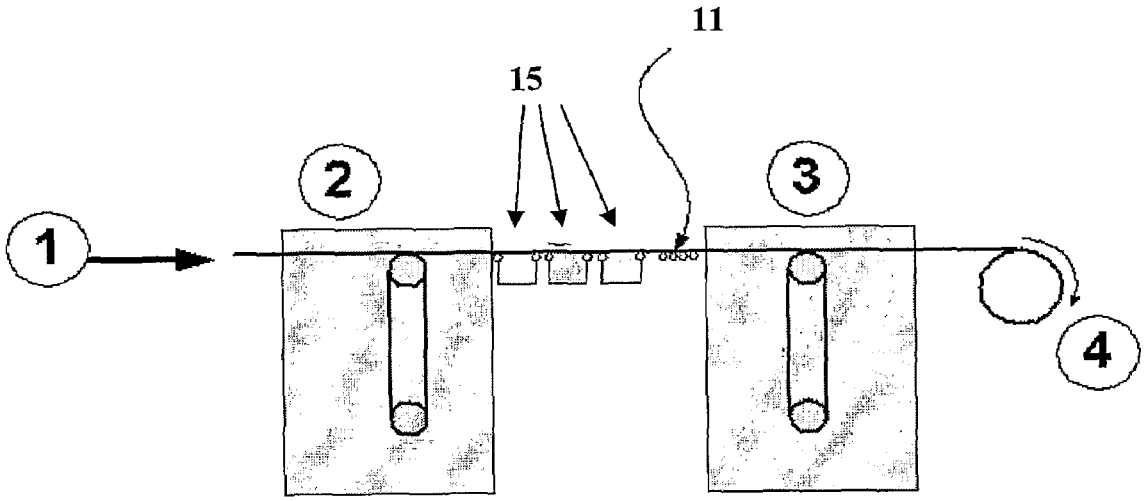
FIG. 7 is a schematic diagram of a wet processing apparatus with added washing trays and stripping pins.

The process of Example 6 was repeated for two feed yarns obtained directly from spinning. However, in this example, yarns were spun into a coagulation bath that was 20 percent phosphoric acid in water in contrast to the water coagulation bath utilized in the previous examples. The process was also modified by replacement of the water sprays with three room-temperature water wash trays 15 and additional, integral stripping pins 11 (FIG. 7).

For each feed yarn (6-1 and 6-2), a liquid sample was taken from the stripping pins, immediately prior to pre-drying, and those liquid samples were found to have a percent by weight phosphoric acid content of 2.35% and 1.07%, respectively. Additional processing details are shown in Table 7.

The washed and neutralized yarns were then tested for residual phosphorus content. The final twice-processed yarn had very low residual phosphorus content and essentially no fusing or damage to the filaments.

TABLE 7

| Samp. | Feed Yarn | First Stage Temp (° C.) | Wraps | Second Stage Temp (° C.) | Wraps | Phosphorus (wt %) |
|---|---|---|---|---|---|---|
| 6(a) | 6-1 | 108 | 6 | — | — | 2.39 |
| 6(b) | 6-1 | 108 | 6 | 200 | 4 | 0.57 |
| 6(c) | 6-1 | 108 | 6 | 200 | 6 | 0.46 |
| 6(d) | 6-1 | 108 | 6 | 200 | 11 | 0.39 |

TABLE 7-continued

| Samp. | Feed Yarn | First Stage Temp (° C.) | Wraps | Second Stage Temp (° C.) | Wraps | Phosphorus (wt %) |
|---|---|---|---|---|---|---|
| 6(e) | 6-2 | 108 | 6 | — | — | 2.19 |
| 6(f) | 6-2 | 108 | 6 | 200 | 4 | 0.69 |
| 6(g) | 6-2 | 108 | 6 | 200 | 6 | 0.43 |
| 6(h) | 6-2 | 108 | 6 | 200 | 12 | 0.30 |

Example 9

The process of Example 6 was repeated for two feed yarns obtained directly from coagulation with the following exceptions. This process was conducted without water sprays and stripping pins. Also, the roll surface temperature for Stage 1 processing the feed yarn was either 110 or 130° C. Additional operating details are shown in Table 8. Samples of the stage 1 processed yarn and the twice-processed yarn were then washed and neutralized.

The washed and neutralized yarns were then tested for residual phosphorus content. The stage 1 yarn had a residual phosphorus content of about 1.74 to 1.84 weight percent and the twice-processed yarn had a residual phosphorus content of about 0.69 to 1.41 weight percent. The twice-processed filaments were also observed to have damage and some fusing of filaments.

TABLE 8

| Samp. | Feed Yarn | First Stage Temp (° C.) | Wraps | Second Stage Temp (° C.) | Wraps | Phosphorus (wt %) |
|---|---|---|---|---|---|---|
| C(a) | C-1 | 130 | 10 | — | — | 1.84 |
| C(b) | C-1 | 130 | 10 | — | — | 1.74 |
| C(c) | C-2 | 110 | 10 | — | — | 1.77 |
| C(d) | C-2 | 110 | 10 | 200 | 7 | 1.26 |
| C(e) | C-2 | 110 | 10 | 200 | 10 | 1.41 |
| C(f) | C-2 | 110 | 10 | 200 | 10 | 1.40 |
| C(g) | C-2 | 110 | 10 | 200 | 15 | 1.14 |
| C(h) | C-1 | 130 | 10 | 200 | 7 | 0.89 |
| C(i) | C-1 | 130 | 10 | 200 | 15 | 0.71 |
| C(j) | C-1 | 130 | 10 | 200 | 15 | 0.69 |

The disclosures of each patent, patent application and publication cited or described in this document are hereby incorporated herein by reference, in their entirety.

Those skilled in the art will appreciate that numerous changes and modifications can be made to the preferred embodiments of the invention and that such changes and modifications can be made without departing from the spirit of the invention. It is, therefore, intended that the appended claims cover all such equivalent variations as fall within the true spirit and scope of the invention.

What is claimed:

1. A process for hydrolyzing polyphosphoric acid in a shaped article comprising polyareneazole polymer and polyphosphoric acid, the process comprising:

a) removing surface liquid from the shaped article; and b) contacting the shaped article with a hot surface having a temperature of at least about 150° degrees C. to hydrolyze polyphosphoric acid; and c) subsequently removing hydrolyzed polyphosphoric acid from the hot-surface-contacted shaped article.

2. The process of claim 1, wherein the hot surface comprises heated rolls.

3. The process of claim 1, further comprising the step of:

d) drying the shaped article provided in step c).

4. The process of claim 1, wherein the polyareneazole polymer is a polypyridazole.

5. The process of claim 4, wherein the polypyridazole is a polypyridobisimidazole.

6. The process of claim 5, wherein the polypyridobisimidazole is poly(1,4-(2,5-dihydroxy)phenylene-2,6-pyrido[2,3-d:5,6-d']bisimidazole.

7. The process of claim 1, wherein the polyareneazole polymer is a polybenzazole.

8. The process of claim 7, wherein the polybenzazole is a polybenzobisoxazole.

9. The process of claim 1, wherein a portion of the polyphosphoric acid is hydrolyzed during the contacting of the shaped article with a hot surface.

10. The process of claim 1, wherein substantially all of the polyphosphoric acid is hydrolyzed during the contacting of the shaped article with a hot surface.

11. The process of claim 1, wherein the shaped article comprises less than 2 percent phosphorus based on shaped article weight after removing hydrolyzed polyphosphoric acid from the shaped article.

12. The process of claim 1, wherein the surface liquid is removed by evaporation, drying, blowing, absorption, scraping, wicking, stripping, dripping, or any combination thereof.

* * * * *